United States Patent [19]

Slama

[11] Patent Number: 5,013,463

[45] Date of Patent: May 7, 1991

[54] PROCESS FOR OVERBASED PETROLEUM OXIDATE

[75] Inventor: Francis J. Slama, Montgomery, Ill.

[73] Assignee: Amoco Corporation, Chicago, Ill.

[21] Appl. No.: 932,305

[22] Filed: Nov. 19, 1986

[51] Int. Cl.[5] ..... C10M 159/20

[52] U.S. Cl. ..... 252/18; 252/39; 252/41; 252/55

[58] Field of Search ..... 252/55, 39, 41, 18

[56] References Cited

U.S. PATENT DOCUMENTS

| | | | |
|---|---|---|---|
| 2,008,490 | 7/1935 | Dietrich et al. | 252/55 |
| 2,779,737 | 1/1957 | Koft | 252/39 |
| 2,798,852 | 7/1957 | Wiese et al. | 252/42.7 |
| 2,864,846 | 12/1958 | Gragson | 252/32.7 R |
| 2,895,978 | 7/1959 | Brooks | 252/55 |
| 2,955,084 | 10/1960 | Bartleson et al. | 252/55 |
| 2,975,205 | 3/1961 | Lucki | 568/958 |
| 2,978,470 | 4/1961 | Christensen | 260/414 |
| 2,982,728 | 5/1961 | Whitney | 252/39 |
| 3,006,847 | 10/1961 | Wiley | 252/18 |
| 3,055,828 | 9/1962 | Wiley | 252/18 |
| 3,055,829 | 9/1962 | Wiley et al. | 252/18 |
| 3,083,161 | 3/1963 | Kluge et al. | 252/32.7 |
| 3,085,064 | 4/1963 | Kreuz et al. | 252/55 |
| 3,182,019 | 5/1965 | Wilks | 252/18 |
| 3,455,823 | 7/1969 | Lawrence et al. | 252/55 |
| 3,509,053 | 4/1970 | Branch | 252/18 |
| 3,537,996 | 11/1970 | Holst | 252/18 |
| 3,658,703 | 4/1972 | Gragson | 252/18 |
| 3,857,790 | 12/1974 | Saunders | 252/18 |
| 4,192,758 | 3/1980 | Dickey | 252/18 |

FOREIGN PATENT DOCUMENTS

| | | |
|---|---|---|
| 1963046 | 7/1970 | Fed. Rep. of Germany . |
| 2827511 | 6/1978 | Fed. Rep. of Germany . |
| 743842 | 3/1952 | United Kingdom . |
| 795172 | 4/1955 | United Kingdom . |
| 818323 | 4/1956 | United Kingdom . |
| 1153200 | 8/1967 | United Kingdom . |

*Primary Examiner*—Olik Chaudhuri
*Assistant Examiner*—Jerry D. Johnson
*Attorney, Agent, or Firm*—Matthew R. Hooper; William H. Magidson; Ralph H. Medhurst

[57] ABSTRACT

A method is disclosed for preparing overbased petroleum oxidates which comprises carbonating a petroleum oxidate in the presence of a base selected from the group consisting of alkali metal compounds and alkaline earth metal components. The petroleum oxidate is made by oxidizing petroleum oil in the presence of a base. The overbased petroleum oxidates are useful as rust inhibitors, dispersants, detergents, friction modifiers and as a substrate for overbased sulfonates, phenates, and salicylates. The overbased sulfonates, phenates and salicylates are easily overbased and have improved storage stability and improved rust inhibition.

13 Claims, No Drawings

PROCESS FOR OVERBASED PETROLEUM OXIDATE

FIELD OF THE INVENTION

This invention relates to a method of preparing overbased petroleum oxidates. More particularly, it relates to a process for preparing an alkali or alkaline earth metal overbased petroleum oxidate by carbonating the petroleum oxidate in the presence of a solubilized alkali or alkaline earth metal compound and to the overbased petroleum oxidate prepared thereby. The overbased alkali metal or alkaline earth metal petroleum oxidate can be an overbased calcium petroleum oxidate, an overbased magnesium petroleum oxidate, or an overbased sodium petroleum oxidate, as well as other overbased petroleum oxidates.

The operation of diesel and spark ignition internal combustion engines is typically accompanied by the formation of sludge, lacquer and resinous deposits which adhere to the moving engine parts and thereby reduce engine efficiency. In order to prevent or reduce the formation of these deposits, a wide variety of chemical additives has been developed for incorporation into lubricating oils. These additives, which are commonly referred to as detergents or dispersants, have the ability to keep deposit-forming materials suspended in the oil so that the engine remains in a clean and efficient operating condition for extended periods of time. Among the many additives which have been developed for this purpose, certain alkaline earth metal salts have been found to be highly effective detergents for lubricating oils.

In addition to serving as highly efficient detergent additives for lubricating oils, alkaline earth metal salts are also excellent oxidation and corrosion inhibitors. Further, these salts have the ability to neutralize acidic combustion products which are formed during engine operation. The formation of these acidic products is a particular problem during engine operation with high sulfur fuels. These acids appear to cause degradation of the lubricating oil and are corrosive to metal engine components such as bearings. If uncontrolled, the corrosion induced by acidic combustion products can cause rapid engine wear and a resulting early engine breakdown.

To further improve the ability of alkaline earth metal salt additives to neutralize acidic combustion products, these additives are commonly overbased.

Although overbased calcium and barium phenates and sulfonates, among other salts, have been widely known and used as detergents and sulfonates, overbased petroleum oxidates and the easy ability to make and use highly overbased petroleum oxidates have not been previously known. The present invention is predicated on the discovery that petroleum oils, oxidized in the presence of an amount of a basic metal salt, such as metal hydroxides or, preferably, an amount of an overbased petroleum oxidate of the same composition as the overbased petroleum oxidate product, can be overbased by carbonation in the presence of an inorganic base. The carbonated overbased product of the petroleum oxidate can be used directly in a lubricant formulation as a rust inhibitor or as a lubricating oil detergent. In addition, the presence of petroleum oxidate facilitates the carbonation process in the preparation of overbased sulfonates, phenates and salicylates.

When petroleum oxidate is used as a modifier for preparing overbased sulfonates, it has been discovered that the carbonation overbasing process is faster and more economical than conventional methods The overbased sulfonate product of the carbonation is more stable under conditions of prolonged heat and storage and is very clear in appearance, without any or with little haze present, thus adding to the product's market acceptance. Sometimes, the overbased sulfonates' Total Base Number (TBN) is increased by using petroleum oxidate as an overbasing modifier.

DESCRIPTION OF THE PRIOR ART

The preparation of oxidized petroleum oils and their use as detergents in lubricating oils is known in the art.

U.S. Pat. No. 2,779,737 to Koft discloses the preparation of calcium salts of oxidized petroleum oils by a process which comprises the steps of oxidizing a petroleum oil in the presence of calcium hydroxide and reacting the product thus obtained with a calcium salt selected from the group consisting of calcium chloride, calcium hypochlorite and a mixture of calcium chloride and calcium hydroxide in the presence of water. The oxidation step is carried out at a temperature within the range of from about 250° F. to about 600° F. while passing air or oxygen through the reaction mixture. By reacting the oxidation product with a calcium salt, calcium content of the oxidized oil product is increased from about 3 equivalents of calcium in the oxidized product to about 3.35 to about 3.65 equivalents of calcium in the reacted product.

U.S. Pat. No. 2,864,846 to Gragson discloses the preparation of alkaline earth salts of oxidized petroleum oils by a process which comprises the steps of oxidizing petroleum oil with air in the presence of an oxidation catalyst, preferably a $P_2S_5$-terpene reaction product, and neutralizing the treated oil with an alkaline earth hydroxide or oxide.

U.S. Pat. 2,895,978 to Brooks discloses a process for oxidation of petroleum oils in the presence of excess amounts of a metal hydroxide over and above that which is eventually taken up by the oil during the oxidation. The metal salts produced contain about 2 equivalents of metal per equivalent of acid-hydrogen formed during the oxidation.

U.S. Pat. No. 2,975,205 to Lucki discloses a process for preparation of metal salts of oxidized petroleum oils which comprises oxidizing petroleum oil in the presence of a metal hydroxide to incorporate the metal hydroxide into the oil and then reacting the product obtained with more metal hydroxide in the presence of water to incorporate an additional amount of metal hydroxide into the product.

U.S. Pat. No. 2,978,470 to Christensen discloses a process for air oxidation of petroleum oils in the presence of a catalyst such as potassium permanganate or potassium stearate. The oxidation is carried out until the change has a saponification number of about 100 to 150.

Accordingly, although the oxidation of petroleum oils to prepare a petroleum oxidate has been known, the prior art neither teaches nor suggests the invented process comprising carbonation of a petroleum oxidate in the presence of an inorganic base to produce a highly overbased petroleum oxidate, which is useful as a detergent, dispersant and rust inhibitor. Also, the prior art neither teaches nor suggests that petroleum oxidate as a process modifier improves overbasing processes for preparing overbased sulfonates, phenates and salicylates useful as lubricating oil detergents and dispersants.

SUMMARY OF THE INVENTION

A process is disclosed for preparation of novel lubricant additives useful in lubricating oils and greases comprising overbased alkali metal and alkaline earth metal petroleum oxidates and for alkali metal and alkaline earth metal oxidate-modified sulfonates, phenates and salicylates with improved storage and heat stability.

DETAILED DESCRIPTION OF THE INVENTION

The invention comprises the method of overbasing an oxidized petroleum oil to produce an overbased petroleum oxidate and the products resulting from the overbasing process. The term "overbased" is applied to designate the presence of basic metal salts wherein the metal is present in stoichiometrically larger amounts than the organic acid radical. The petroleum oil is oxidized by an oxygen-containing gas or compound in the presence of a base. The presence of a base is an essential element of the oxidation process. The base can be insoluble, such as sodium hydroxide, but a soluble base such as an overbased sulfonate is preferred. Air oxidation in the presence of an overbased petroleum oxidate of calcium, magnesium or sodium as catalyst is more preferred. Other overbased petroleum oxidates of barium, potassium and strontium can also be used. The resulting petroleum oxidate has a TBN of about 1-10. The petroleum oxidate can be treated with inorganic base and carbonated to yield a clear, overbased oxidate of high TBN.

In another aspect of this invention, the petroleum oxidate can be used to modify well-known processes used to make overbased sulfonates and phenates. Such modification with oxidate often results in process or product improvements. Sodium, calcium and magnesium overbased petroleum oxidates are clear liquids useful as rust inhibitors, dispersants, detergents and friction modifiers. Sulfonates overbased in the presence of petroleum oxidates have improved rust inhibitor properties with a low sulfonate soap content. Phenates overbased in the presence of petroleum oxidates are semi-solid and solid materials with lubricating properties as greases. Salicylates overbased in the presence of petroleum oxidates also demonstrate lubricant properties as grease materials.

A satisfactory feedstock for the invented process is that prepared from topped crude oils obtained from any source, for example, Pennsylvania, Mid-Continent, California, East Texas, Gulf Coast, Venezuela, Borneo and Arabian crude oils. In this method, a crude oil is topped, i.e., distilled to remove therefrom more volatile and light gas oil, and then vacuum-reduced to remove heavy gas oil and light lubricating oil of the SAE-10 and 20 viscosity grade. The vacuum-reduced crude is then propane fractioned to remove additional heavier fractions of lubricating quality hydrocarbons.

Following the propane fractionation step, the overhead oil fraction is solvent-extracted with a selective solvent which will separate the paraffinic hydrocarbons from the more aromatic type hydrocarbons. This solvent extraction step for the removal of the more highly aromatic compounds can be carried out in accordance with the well-known concurrent or countercurrent solvent extraction techniques which are well known in the art.

The resulting solvent-extracted material, before or after the removal of the more aromatic hydrocarbons, is preferably dewaxed. The dewaxing can be carried out by any conventional method, e.g., by solvent dewaxing using propane or other known solvents and solvent mixtures such as methylethylketone or methylisobutylketone with benzene at a suitable temperature.

A preferred feed material for the oxidation reaction is a substantially saturated hydrocarbon fraction having at least 40 carbon atoms per molecule, preferably between 40 and 80 carbon atoms per molecule, a refractive index $n_D^{20}$ of between 1.440 and 1.520, an average molecular weight between 550 and 1300, a viscosity of between 50 and 1400 SUS at 210° F., and a viscosity index, when determinable, of between 50 and 125.

The oxidizing reaction of the petroleum feed material is accomplished in the presence of a basic catalyst by contacting the selected hydrocarbon fraction, as hereinbefore described, under suitable conditions of temperature and pressure with an oxidizing agent such as free oxygen, sulfur trioxide, nitrogen dioxide, nitrogen trioxide, nitrogen pentoxide, acidified chromium oxide and chromates, permanganates, peroxides, such as hydrogen peroxide, and sodium peroxide, nitric acid and ozone. Any oxygen-containing material capable of releasing molecular oxygen under the conditions can be used. Air is a preferred oxidizing agent from the standpoint of economy.

Generally, the oxidation reaction is carried out at a temperature in the range from −40° F. to 800° F. When air is used as the oxidizing agent, temperatures in the range of 100° F. to 800° F., preferably 390° F. to 575° F., are generally used. When nitric acid is used as the oxidation agent, temperatures ranging from room temperature up to 200° F., preferably 140° F. to 170° F., are ordinarily used.

The oxidation reaction can be carried out at sub-atmospheric, atmospheric or super-atmospheric pressure. The reaction is preferably carried out at a pressure of between about 10 to 100 pounds per square inch absolute depending upon the composition of the oxidizing gas.

A basic catalyst must be present during the oxidation of the petroleum feed stock. An oxidation catalyst also can be present to promote the oxidation reaction. The oxidation catalyst can be selected from the group of wellknown oxidation catalysts such as oil-soluble salts and compounds containing such metals as copper, iron, cobalt, lead, zinc, cadmium, silver, manganese, chromium and vanadium.

Any base may be used as the basic catalyst. It can be soluble or insoluble. Typical basic catalysts include calcium hydroxide, sodium hydroxide, overbased sodium, calcium or magnesium sulfonate, or an overbased oxidate of high TBN (one of the products of this invented process).

Powdered, insoluble catalysts such as calcium hydroxide are inexpensive, but the oxidate must then be filtered to remove inreacted base. In order to eliminate the need for this filtering step, it is preferred to use a homogeneous base, for example, a high-base calcium sulfonate. Enough base must be used so that the total mass of oil and base has a TBN of at least 2 before oxidation. There is no upper limit to the amount of homogeneous base which can be used, but economically it is undesirable to use more than 3% of this component.

For example, if the basic catalyst is sodium hydroxide, calcium hydroxide, 300 TBN calcium sulfonate, 400 TBN magnesium sulfonate, or 400 TBN sodium oxidate, the minimum base levels necessary to yield a highly overbasable oxidate would be 0.14%, 0.13%, 0.67%, 0.5%, or 0.5%, respectively. Chemically, there is no upper limit for these bases, but there are practical upper limits. For the inexpensive insoluble bases such as sodium or calcium hydroxide, unreacted base must be filtered, and it is convenient to limit the level of base to about 2–3%. For the more expensive soluble bases such as overbased sulfonates, 2–3% is always adequate and can be described as the upper practical limit. The use of very high levels of overbased sulfonate as catalyst would thwart the very usefulness of this invention, namely, a less expensive overbasing substrate (soap) than sulfonate.

Since the product, high-base petroleum oxidate, of the invented process is less expensive than high-base sulfonate, it is less costly to use the high base petroleum oxidate as catalyst instead of high-base sulfonate. Homogeneous catalysts, such as high base calcium sulfonate, have been used at levels of 1% to 3% in the base oil. The resulting petroleum oxidate has a TBN of at least 2. Although the oxidate can have a high TBN, the upper limit should be about 12 TBN for economic reasons. Typical petroleum oxidates will have TBNs of about 5–8.

Unexpectedly, it has been found that highly overbased products (100 TBN and higher) can be made using these oxidates as an inexpensive substrate instead of the usual phenate, sulfonate, or salicylate. It has been discovered that these oxidates can be used to facilitate overbasing phenates and sulfonates to unexpectedly high TBNs not previously considered possible by conventional methods.

The oxidates prepared as described above can be overbased by carbonating to clear, highly alkaline products. The exact reason as to why clear, highly alkaline products result from using petroleum oxidate as the substrate is not known, but it is believed that the alkaline salts of Group I and Group II metals are finely dispersed by the oxidate. The products have TBNs much higher than previously achieved, as taught in the prior art.

Unexpectedly, it has been found also that use of the oxidate to prepare overbased sulfonate, phenate or salicylate products results in improved products over those prepared by methods taught in the prior art. For example, use of oxidate in overbasing magnesium sulfonate can improve clarity of the product.

Unexpectedly, it has also been found that use of a petroleum oxidate as the substrate in overbasing a sulfonate by carbonation can result in an overbased product with a low viscosity as compared with the viscosity of an overbased sulfonate prepared without use of petroleum oxidate.

Examples of overbased sulfonates or carboxylates which can be prepared with use of a petroleum oxidate substrate are overbased alkali and alkaline earth metal salts of sulfonic acids or carboxylic acids, typically salts of sodium, potassium, lithium, calcium, magnesium, strontium or barium prepared from sodium, potassium, lithium, calcium, magnesium, strontium or barium sulfonates, phenates or salicylates. The sulfonic acids can be derived from petroleum sulfonic acids such as alkylbenzene sulfonic acids. Examples of carboxylic acid salts prepared with use of a petroleum oxidate substrate include overbased phenates, both low-base phenates of TBN of 80–180 TBN and high-base phenates of about 250 TBN, and salicylates, prepared by reacting alkali or alkaline earth metal bases with alkyl salicylic acids. TBNs of so-prepared overbased salicylates can range from about 120 to about 250.

The overbased sulfonates prepared by the process of this invention are preferably magnesium, calcium or sodium sulfonates. Magnesium sulfonates are preferably made from alkylbenzene sulfonic acids and typically will have a TBN of about 400 with a sulfonate soap content of about 28%. Calcium sulfonates preferably are from alkylbenzene sulfonic acids and typically will have TBNs ranging from 1 300–400 with sulfonate soap contents ranging from about 20–30%. Sodium sulfonates preferably are made from alkylbenzene sulfonic acids and typically will have TBNs of about 400 and a soap content of about 18%. Low-base sulfonates prepared by the process of this invention are typically calcium sulfonate and preferably are made from alkylbenzene sulfonic acids. These low-base sulfonates typically will have TBNs of 15 to 40 and a soap content of about 40%.

The commonly employed methods for preparing the basic salts involves heating a mineral oil solution of an acid with a stoichiometric excess of a metal neutralizing agent such as the metal oxide, hydroxide, carbonate, bicarbonate or sulfide at a temperature about 50° C. and filtering the resulting mass. The use of a "promoter" in the neutralization step and the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, Cellosolve, Carbitol, ethylene glycol, stearyl alcohol, and cyclohexyl alcohol, amines such as aniline, phenylenediamine, phenothamine, phenyl beta-naphthylamine, and dodecylamine. A particularly effective method for preparing the basic salts comprises mixing an acid with an excess of a basic alkaline earth metal neutralizing agent, a phenolic promoter compound, and a small amount of water and carbonating the mixture at an elevated temperature such as 60–200° C.

The overbasing process is carried out in the presence of an organic solvent if more fluidity is desired. Such solvents can be benzene, toluene, xylene or rafinate, among others.

The invented process for preparation of an overbased alkali metal or alkaline earth metal petroleum oxidate additive for lubricants with detergent, dispersant, antirust and friction modifying properties accordingly comprises: (a) introducing into a reaction zone a petroleum oil, (b) a base selected from the group consisting of an alkali metal compound or an alkaline earth metal compound to form a mixture, (c) contacting said mixture with an oxidizing gas or compound at a temperature from about −40° F. to about 800° F. to effect oxidation of said petroleum oil and reaction of said base with the oxidized oil, (d) optionally, filtering said mixture to separate the base-reacted oxidized oil, (e) carbonating said base-reacted oxidized oil in the presence of a base selected from the group consisting of an alkali metal compound and an alkaline earth metal compound to form a mixture comprising water and an overbased alkali metal or alkaline earth metal petroleum oxidate, (f) optionally filtering said mixture to remove unreacted alkali metal compound or alkaline earth metal compound, and (g) stripping said overbased alkali metal or alkaline earth metal oxidate additive to remove water.

The alkali metal compound or alkaline earth metal compound for step (b) is selected from the group consisting of the oxides, hydroxides and carbonates of sodium, potassium, calcium, magnesium, barium and strontium.

The alkali metal compound or said alkaline earth metal compound for steps (b) and (e) also can be selected from the group consisting of oxides, hydroxides, carbonates, sulfonates, phenates, salicylates and an overbased petroleum oxidate. The alkali metal compound or alkaline earth metal compound of step (b) also can be selected from the group consisting of oxides, hydroxides and carbonates of sodium, potassium, calcium, magnesium, barium and strontium, and said alkali metal or alkaline earth metal compound of step (e) can be selected from the group consisting of sulfonates, phenates, salicylates, and an overbased petroleum oxidate.

As an example, the process of the instant invention for preparing an overbased magnesium sulfonate comprises: (a) adding to a suitable vessel a charge mixture of (1) about 30 to 90 parts by weight of ammonium sulfonate, (2) about 50 to 120 parts by weight of No. 100 neutral petroleum oil oxidized to petroleum oxidate, (3) about 100 to 400 parts by weight of xylene, and (4) about 25 to about 60 parts by weight of magnesium oxide wherein said magnesium oxide is added during mixing at ambient temperature to about reflux temperature of said charge mixture; (b) heating said charge mixture to about 100° F. wherein from about 10 to about 35 parts by weight of methanol is added and heating is continued up to about 140° F. wherein about 30 to 60 parts by weight of water is added, and the resulting mixture is refluxed for up to 4 hours; (c) distilling said mixture to remove methanol, water and xylene at a temperature of up to about 225° F. at ambient pressure; (d) cooling said mixture to about 100° F. and thereupon carbonating said mixture with about 35 to about 90 parts by weight of carbon dioxide at a temperature of about 60° F. to about 200° F. until said mixture is saturated; (e) removing magnesium oxide impurities by centrifuge or filtration; and (f) removing remaining xylene, methanol and water by distillation at a reflux temperature.

The following examples are illustrative of typical embodiments of this invention and should not be considered as limiting the scope of the invented process and compositions.

EXAMPLE I

The following example illustrates the preparation of an oxidized calcium mineral oil which can be overbased to yield oil-miscible alkaline agents.

A suitable vessel was charged with:

679 g Amoco Oil HX-40

21 g high-base calcium sulfonate (300 TBN)

10 ft.$^3$/hr. air

The mixture was heated to a temperature of 400° F. for hours. The product exhibited an activity of 68% on silica gel with hexane as eluent in an elution column. It needed no filtering because the basic catalyst was soluble. It had a TBN of 7.

EXAMPLE II

In the procedure of Example I, a sodium oxidate was prepared. A suitable vessel was charged with:

980 g Amoco Oil HX-40

20 g 400 TBN Sodium-Overbasd Oxidate (as prepared in Example V)

10 ft.$^3$/hr air

The mixture was heated to a temperature of 400° F. for 7.5 hours. Water collected overhead was 14 g. Light oil collected in a dry ice condenser was 9 g. The product was active on silica gel in an elution column using hexane as the eluent. The product needed no filtering, and it had a TBN of 6. The product could also be made using NaOH as the basic catalyst, but then it would have to be filtered to remove unreacted base.

EXAMPLE III

In the procedure of Example I, a magnesium oxidate was prepared. A suitable vessel was charged with:

2,910 g Amoco Oil HX-40

90 g high-base magnesium sulfonate (400 TBN)

10 ft$^3$ air/hr

The mixture was heated at 395° F. for 4 hours. The product was 39% active on silica gel in an elution column, using hexane as the eluent. The product was clear without filtration and had a TBN of 9.

EXAMPLE IV

The product from Example I was overbased with calcium as follows:

To a 2-liter, 3-neck round bottom flask fitted with a heating mantle, reflux condenser, stirrer and dropping funnel there was added 100 ml calcium oxidate from Example I, 300 ml xylene, and 10 grams calcium oxide. The mixture was then heated, and 5.5 grams of methanol were added when its temperature reached 38° C., and 0.9 grams of water were added when its temperature reached 60° C. Heating was continued and the resulting mixture heated at reflux (about 81° C.) for 10 hours. A Dean Stark water trap was placed between the reaction flask and the reflux condenser. After cooling to 38° C., the mixture was treated with gaseous carbon dioxide which was introduced below the surface of the reaction mixture at a rate of 0.41 liter/minute over a period of 8 minutes while the reaction mixture was maintained at a temperature of 38°–46° C. A total of 3.3 liters of carbon dioxide were absorbed by the reaction mixture. The mixture was then heated to 121° C. to remove water by way of a Dean Stark water trap. Next, 10 grams calcium oxide, 0.9 grams water and 5.5 ml methanol were added and the resulting mixture carbonated with carbon dioxide for 9 minutes. An additional 2.0 liters of carbon dioxide were absorbed. Finally, the mixture was cooled to 100° F. and filtered. The filtrate was nitrogen-stripped at a temperature of about 360° F. to remove water and methanol.

The overbased calcium oxidate had a TBN of 120, a level of calcium oxidate overbasing not previously known in the prior art. To my knowledge, use of petroleum oxidate as the substrate for overbasing to such a high TBN was not taught or suggested in the prior art.

Although acidic substrates such as sulfonic acids, phenols, carboxylates and other acidic compounds are widely used to make overbased products and, although it has long been known that mineral oils oxidize in the presence of air at high temperatures, it has not been previously known that mineral oil can be oxidized to make clear substrates which can be overbased to make highly (e.g., TBNs 100–500) alkaline agents suitable as rust inhibitors or detergents.

EXAMPLE V

The petroleum oxidate from Example II was overbased with sodium as follows: To a 2-liter, 3-neck round bottom flask fitted with a heating mantle, reflux condenser, stirrer and dropping funnel there was added 100 grams petroleum oxidate from Example II, 200 ml xylene and 370 grams of 20% NaOH in methanol. The mixture was stirred and heated to about 225° F., removing and condensing the volatiles coming off as overhead. Then 16.8 liters of carbon dioxide were introduced into the mixture at a rate of 0.6 l/minute at a temperature of 225° F. Carbonation was then stopped, and the mixture was cooled to 100° F. and filtered. The filtrate was then heated to about 360° F. and nitrogen-stripped for a period of about 1 hour to remove water and xylene. The resulting product was a clear, amber fluid and had a TBN of 413. To my knowledge, an overbased sodium oxidate with a high TBN has not been previously known, and the prior art does not suggest the possibility.

EXAMPLE VI

Petroleum oxidate from Example III was overbased with magnesium as follows: To a 2-liter, 3-neck round bottom flash fitted with a heating mantle, reflux condenser, stirrer and dropping funnel, there was added 65 grams of magnesium petroleum oxidate from Example III, 100 grams xylene, 20 grams magnesium oxide and 25 ml methanol. The mixture was refluxed at a temperature of about 180° F. for a period of about one minute. Water, 40 ml, was added and the mixture was again refluxed at a temperature of about 220° F. for about one hour. The mixture was then nitrogen-stripped at a temperature of about 280° F. for a period of about 20 minutes to remove methanol which also removed some water. The mixture was cooled to about 120° F. and 17 ml water was added. Carbon dioxide was introduced into the mixture at a rate of 0.6 l/min. for a period of about 30 minutes. Approximately 5 liters of carbon dioxide were absorbed. The mixture was cooled and filtered. The filtrate was nitrogen-stripped at 360° F. to remove water, xylene and remaining methanol. The product, an overbased magnesium oxidate, was a clear amber liquid with a TBN of 147. To my knowledge, overbased magnesium oxidates of such high TBN have not been reported in the prior art.

EXAMPLE VII

An overbased magnesium sulfonate oxidate was prepared. To a suitable vessel there was added 30 grams alkylbenzene sulfonic acid (molecular weight 732), 16.1 grams SAE 20 base oil, 106.9 grams petroleum oxidate prepared as in Example III, and 350 ml xylene. After mixing and heating to 100° F., ammonia gas was bubbled into the mixture to neutralize the mixture. Magnesium oxide, 37 grams, with 17 ml of methanol was then added with stirring at a temperature of 100° F. Temperature was raised to reflux, approximately 180° F., and 35 ml water was added after which the mixture was refluxed for approximately one hour. The mixture was nitrogen-stripped to a temperature of about 280° F. to remove volatiles comprising principally methanol, but some water was also removed. The mixture was allowed to cool to about 120° F. after stripping and 33 ml water was added. Carbon dioxide was introduced into the mixture at a rate of 0.6 l/min. for a period of 25 minutes. Eighteen liters of carbon dioxide were absorbed. The mixture was allowed to cool to 100° F. and was filtered. The filtrate was nitrogen-stripped to remove solvent and water at a temperature of 360° F. The product was a clear amber liquid, had a TBN of 396 and contained 13.2 (wt)% sulfonate soap. The product was clear, neat and in benzene solution. Prior art does not teach or suggest the preparation of an overbased magnesium sulfonate oxidate with a TBN of 396 and a low level of soap in a clear product.

EXAMPLE VIII

Formulated oils containing the additives shown in Table I were prepared and tested in a Sequence II D Test Method. This procedure uses a 1977, 350 CID (5.7 liter) Oldsmobile V-8 engine at moderate speed (1500 rpm) for 30 hours followed by a shutdown for 30 minutes and 2 hours of high speed (3600 rpm) operation. The test is run with leaded gasoline. The test measures the tendency of an oil to rust or corrode the valve train. After the run, the engine is disassembled and the condition of the valve train is visually measured by trained operators against a standard of 1 to 10. A 10 is no rust. The high-base magnesium sulfonate oxidate prepared in Example VII was the additive used. The control was a commercially available magnesium sulfonate supplied by Amoco Petroleum Additives Company, Clayton, Mo. The sulfonate oxidate performed well in the II D test.

TABLE I

| Formulation (wt) % | Control | Ex. VII Mg Sulfonate |
|---|---|---|
| Base Oil, 20 SAE | 83.73 | 83.73 |
| V.I. Improver | 10.60 | 10.60 |
| 400 TBN Mg Sulfonate | 1.00 | 0 |
| 400 TBN Mg Sulfonate Oxidate | 0 | 1.00 |
| Other Additives | 4.67 | 4.67 |
| | 100.0 | 100.0 |
| II D Test Average Rust | 8.07 | 8.73 |

EXAMPLE IX

In this example, oxidate is used to facilitate the carbonation process during overbasing to produce a 400 TBN magnesium sulfonate. The overbasing process was similar to that in Example VII, except for the amounts of raw materials charged. The carbonation proceeded much more smoothly in the run in which mineral oil was replaced by oxidate.

| | |
|---|---|
| Run 145A: | 90 g sulfonic acid blend<br>63 g Amoco Oil SX-5 mineral oil<br>Carbonation: 16 l absorbed in 75 min, with $CO_2$ supplied at 0.75 l/min |
| Run 147A: | 90 g sulfonic acid blend<br>63 g oxidate prepared in the method of Example III<br>Carbonation: 19 l absorbed in only 35 min. with $CO_2$ supplied at 0.75 l/min |

EXAMPLE X

Overbased alkali metal and alkaline earth metal sulfonates, phenates and salicylates, prepared wherein the substrate is a petroleum oxidate, demonstrate improved properties such as less haze.

The runs from Example IX provide an example of better solubility (less haze) in overbased sulfonates modified with oxidate.

| | |
|---|---|
| Run 145A, control run | Haze in hexane = N |
| Run 147A, oxidate modified | Haze in hexane = F |

Haze in hexane is defined as the haze of a solution consisting of 5% test sulfonate and 95% hexane, as measured on an Amoco Hazeometer. Range of haze values is from A (clearest) to N (haziest).

EXAMPLE XI

The influence of oxidate in modifying the carbonation process can control the viscosity of the final overbased products. The viscosity effect, accordingly, can be controlled, depending upon the type of product that is desired. The oxidate effect in Run 147A from Example IX controls the viscosity of the product to produce an oil additive for which a low viscosity is desired. The viscosity of the control, Run 145A from Example IX, was very high.

| | |
|---|---|
| Run 145A, control run | 9,733 cSt at 100° C. |
| Run 147A, oxidate-modified | 85 cSt at 100° C |

EXAMPLE XII

In some sulfonate overbasing processes, the presence of oxidate increases the efficiency with which the available metal is carbonated and incorporated into the product. An example is the overbasing of calcium sulfonate by the following process.

The following runs were made in a suitable vessel. Runs 160-1 and 160-2 were controls. Run 160-3 was modified by using calcium oxidate, as produced in Example I, to replace the SX-5 oil. Run 160-3 utilized over 30% more lime than controls 160-1 and 160-2.

Run 160-1, control run (1) 64.3 g ammonium sulfonate, 56% soap, 644 MW 108.8 g Amoco SX-5 mineral oil 400 ml xylene (2) blow with ammonia (3) add 65 g CaO, 6 ml water, 35.4 ml methanol; carbonate at 115°-125° F.

(4) add 24 g CaO, 2.2 ml water, 2.4 ml methanol; carbonate at 115°-125° F.

(5) repeat step 4

(6) strip to 195° F., cool to 190° F., add 4 ml water, stir 15 min (7) strip to 260° F., filter, strip to 360° F.

| | |
|---|---|
| Results: 31.3 liters of $CO_2$ absorbed: | |
| | TBN = 331 |
| | Lime utilized = 36% |
| Control Run 160-2, repeat of Run 160-1 | |
| | TBN = 334 |
| | Lime utilized = 37% |
| Run 160-3, oxidate-modified | |
| | 34.4 l $CO_2$ absorbed |
| | TBN = 408 |
| | Lime utilized = 49% |

The TBN of the oxidate-modified sulfonate, 408, was approximately 22% greater than the TBN of the control sulfonate, 334, demonstrating the increased efficiency of carbonating the oxidate-modified product.

What is claimed is:

1. A process for preparation of an overbased alkali metal or alkaline earth metal petroleum oxidate additive for lubricants useful as a detergent, dispersant, and antirust friction modifier which process comprises:

(a) introducing into a reaction zone a petroleum oil, (b) a base selected from the group consisting of an alkali metal compound or an alkaline earth metal compound to form a mixture, (c) contacting said mixture with an oxidizing gas or compound at a temperature from about −40° F. to about 800° F. to effect oxidation of said petroleum oil and reaction of said base with the oxidized oil, followed by (d) optionally filtering said mixture to separate the base-reacted oxidized oil as a petroleum oxidate, (e) carbonating said petroleum oxidate in the presence of a base selected from the group consisting of an alkali metal compound and an alkaline earth metal compound to form a reaction product comprising an overbased alkali metal or alkaline earth metal petroleum oxidate, (f) optionally filtering said mixture to remove unreacted alkali metal compound or alkaline earth metal compound, and (g) stripping said overbased alkali metal or alkaline earth metal petroleum oxidate to remove water.

2. The process of claim 1 wherein metal of said alkali metal compound or alkaline earth metal compound for steps (b) and (e) is selected from the group consisting of sodium, potassium, calcium, magnesium, barium and strontium.

3. The process of claim 2 wherein said alkali metal compound or said alkaline earth metal compound for steps (b) and (e) is selected from the group consisting of oxides, hydroxides, carbonates, sulfonates, phenates, salicylates and an overbased petroleum oxidate.

4. The process of claim 2 wherein said alkali metal compound or alkaline earth metal compound of step (b) is selected from the group consisting of oxides, hydroxides and carbonates of sodium, potassium, calcium, magnesium, barium and strontium, and said alkali metal or alkaline earth metal compound of step (e) is selected from the group consisting of sulfonates, phenates, salicylates, and an overbased petroleum oxidate.

5. The process of claim 1 wherein said alkali metal compound or alkaline earth metal compound in step (e) is present in an amount equivalent to at least 2 TBN(Total Base Number).

6. The process of claim 1 wherein said oxidizing gas contains molecular oxygen.

7. An overbased alkaline earth metal petroleum oxidate prepared by a process comprising steps (a) to (c), step (e) and step (g) of the process set forth in claim 1.

8. The overbased alkaline earth metal petroleum oxidate of claim 7 wherein the alkaline earth metal is calcium.

9. The overbased alkaline earth metal petroleum oxidate of claim 7 wherein the alkaline earth metal is magnesium.

10. An overbased alkali metal petroleum oxidate prepared by a process comprising steps (a) to (c) step (e) and step (g) of the process set forth in claim 1.

11. The alkali metal petroleum oxidate of claim 10 wherein the alkali metal is sodium.

12. A lubricating composition comprising a major amount of lubricating oil or grease and an overbased alkaline earth metal petroleum oxidate prepared by a process comprising steps (a) to (c), step (e) and step (g) of the process set forth in claim 1.

13. A process for carbonate overbasing of an alkali or alkaline earth metal sulfonate, phenate or salicylate which comprises conducting said carbonate overbasing of the sulfonate, phenate or salicylate in the presence of a petroleum oxidate overbasing modifier, said modifier being obtained by a process comprising (a) introducing into a reaction zone a petroleum oil and a base selected from the group consisting of an alkali metal or alkaline earth metal compound to form a mixture; and (b) contacting said mixture with an oxidizing gas or compound at a temperature from about −40° F. to about 800° F. to effect oxidation of said petroleum oil and reaction of said base with the oxidized oil.

* * * * *

UNITED STATES PATENT OFFICE
CERTIFICATE OF CORRECTION

Patent No. 5,013,463 Dated May 7, 1991

Inventor(s) Francis J. Slama

It is certified that error appears in the above-identified patent and that said Letters Patent is hereby corrected as shown below:

Patent reads:

| Col. | Line | |
|---|---|---|
| 8 | 8 | "was active" and should read --was 50% active-- |

Signed and Sealed this

Third Day of November, 1992

*Attest:*

DOUGLAS B. COMER

*Attesting Officer*

*Acting Commissioner of Patents and Trademarks*